US008941309B2

(12) United States Patent
Wu et al.

(10) Patent No.: US 8,941,309 B2
(45) Date of Patent: Jan. 27, 2015

(54) VOLTAGE-DRIVEN PIXEL CIRCUIT, DRIVING METHOD THEREOF AND DISPLAY PANEL

(75) Inventors: Zhongyuan Wu, Beijing (CN); Gang Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 13/698,003

(22) PCT Filed: Sep. 5, 2012

(86) PCT No.: PCT/CN2012/081012

§ 371 (c)(1), (2), (4) Date: Nov. 14, 2012

(87) PCT Pub. No.: WO2013/034075

PCT Pub. Date: Mar. 14, 2013

(65) Prior Publication Data

US 2013/0175941 A1 Jul. 11, 2013

(30) Foreign Application Priority Data

Sep. 6, 2011 (CN) ..... 2011 1 0262088

(51) Int. Cl.

*G09G 3/10* (2006.01)
*H05B 33/08* (2006.01)
*G09G 3/32* (2006.01)

(52) U.S. Cl.

CPC ..... *H05B 33/0896* (2013.01); *G09G 3/3233* (2013.01); *G09G 3/3291* (2013.01); *G09G 2300/0819* (2013.01); *G09G 2300/0842* (2013.01); *G09G 2300/0861* (2013.01); *G09G 2320/043* (2013.01); *G09G 2300/0852* (2013.01)

USPC ..... 315/169.3; 345/76; 345/82

(58) Field of Classification Search

USPC ..... 315/169.1–169.4; 345/76–83, 204–215

See application file for complete search history.

(56) References Cited

U.S. PATENT DOCUMENTS

2005/0200572 A1* 9/2005 Weng ..... 345/76
2008/0042939 A1 2/2008 Yamashita et al.
2009/0027312 A1* 1/2009 Han et al. ..... 345/76

(Continued)

FOREIGN PATENT DOCUMENTS

CN 101127183 A 2/2008
CN 101373578 A 2/2009

(Continued)

OTHER PUBLICATIONS

Joon-Chul Goh, et al; "A New Pixel Circuit for Active Matrix Organic Light Emitting Diodes", IEEE Electron Device Letters, vol. 23, No. 9; Sep. 2002, pp. 544-546.

(Continued)

*Primary Examiner* — Thienvu Tran
*Assistant Examiner* — Christopher Lo
(74) *Attorney, Agent, or Firm* — Ladas & Parry LLP

(57) ABSTRACT

A voltage-driven pixel circuit, a driving method thereof and a display panel including the voltage-driven pixel circuit are disclosed. The voltage-driven pixel circuit comprises a driving transistor, a retaining transistor, a switching transistor, a compensating transistor, a storage capacitance and an OLED device. The technical solutions disclosed here compensate for the unevenness of the threshold voltage of the N-type TFT transistors and OLED efficiently.

7 Claims, 5 Drawing Sheets

(56) References Cited

U.S. PATENT DOCUMENTS

| | | | | |
|---|---|---|---|---|
| 2009/0051628 | A1 | 2/2009 | Kwon | |
| 2009/0166638 | A1 | 7/2009 | Honda | |
| 2010/0007583 | A1 | 1/2010 | Handa et al. | |
| 2010/0156762 | A1* | 6/2010 | Choi | 345/76 |
| 2011/0063198 | A1* | 3/2011 | Chung et al. | 345/82 |
| 2011/0069058 | A1* | 3/2011 | Chung et al. | 345/212 |
| 2011/0164018 | A1* | 7/2011 | Kang et al. | 345/211 |

FOREIGN PATENT DOCUMENTS

| | | | |
|---|---|---|---|
| CN | 101625831 | A | 1/2010 |
| CN | 102651194 | A | 8/2012 |
| JP | 2009-025821 | A | 2/2009 |
| KR | 20090071452 | A | 7/2009 |

OTHER PUBLICATIONS

Joon-Chul Goh, et al; "A New a-Si:H Thin-Film Transistor Pixel Circuit for Active-Matrix Organic Light-Emitting Diodes", IEEE Electron Device Letters, vol. 24, No. 9, Sep. 2003; pp. 583-585.

Jac-Hoon Lee, et al; "A New a-Si:H TFT Pixel Circuit Compensating the Threshold Voltage Shift of a-Si:H TFT and OLED for Active Matrix OLED", IEEE Electron Device Letters, vol. 26, No. 12, Dec. 2005; pp. 897-899.

Yeon Gon Mo, et al; "69.3: Amorphous Oxide TFT Backplane for Large Size AMOLED TVs", SID Symposium Digest of Technical Papers; vol. 41, Issue 1, pp. 1037-1040, May 2010.

International Search Report: dated Sep. 6, 2011 PCT/CN2012/081012.

First Chinese Office Action dated Nov. 13, 2013; Appln. No. 201110262088.0.

* cited by examiner (1) initialization stage
(2) compensation stage
(3) light emission maintaining stage

VOLTAGE-DRIVEN PIXEL CIRCUIT, DRIVING METHOD THEREOF AND DISPLAY PANEL

BACKGROUND

The technique disclosed relates to a voltage-driven pixel circuit, a driving method thereof and a display panel.

Organic Electroluminesence Display (OLED) has been increasingly used in the display of high performance as a current-type light emitting device. The traditional Passive Matrix OLED requires shorter time for driving single pixel as the display size increases, and thus requires increasing the instant current which increases the power consumption. At the same time, a large current may lead to a overlarge voltage drop on the ITO line and make the operation voltage of OLED too large, which reduces the efficiency thereof. While Active Matrix OLED (AMOLED) can solve these problems well by scanning input OLED currents progressively using a switching transistor.

In the designing of an AMOLED back plate, however, the unevenness of luminance from pixel to pixel is a problem.

Firstly, AMOLED employs thin film transistors (TFT) to construct a pixel circuit for providing a corresponding current to the OLED device. Low Temperature Poly-silicon thin film transistor (LTPS TFT) or Oxide thin film transistor (Oxide TFT) is often used. The LTPS TFT and Oxide TFT have higher mobility and more stable property and are more suitable for being applied to the display of AMOLED as compared with the general amorphous silicon thin film transistor (a-Si TFT). For the LTPS TFT made on a glass substrate of large area, however, the unevenness in electrical parameters such as a threshold voltage, a mobility or the like arises due to the limitation of a crystallization process and will transform to a current difference or a lightness difference of the OLED display device that will be perceived by human eyes, i.e. a mura phenomena. Although the process evenness of Oxide TFT is better, the threshold voltage thereof will shift under a long-time voltage and high temperature similarly to a-Si TFT, and the shift amounts of the thresholds for the respective parts of the panel will be different due to different display pictures, which results in the difference in display lightness. Since such a difference relates to the image displayed previously, it usually presents as an afterimage phenomena.

Secondly, in a display application of large size, as a power supply line of a back plate has a certain resistance and driving currents for all pixels are supplied by ARVDD, the supply voltage in a region close to a supplying position of the ARVDD power supply in the back plate is higher than that in a region far from the supplying position, which is referred to as IR Drop. Since the voltage of ARVDD is associated with the current, the IR Drop will cause the current differences in different regions, and accordingly a mura occurs in displaying. A LTPS process, which constructs a pixel unit by using P-Type TFTs, is especially sensitive to such a problem, because the storage capacitance thereof is connected between the ARVDD and a gate of TFT and thus a change of the ARVDD voltage will affect the Vgs of the TFT transistor directly.

Thirdly, the unevenness of the film thickness in vapor plating of the OLED device may cause the unevenness of electrical performances. For an a-Si or Oxide TFT process constructing a pixel unit with N-Type TFTs, the storage capacitance thereof is connected between a gate of a driving TFT and an anode of OLED. When a data voltage is transmitted to the gates, the Vgs voltages actually applied on the TFTs will be different if the anode voltages of the respective pixels are different, thereby different driving currents results in different display lightness.

AMOLED can be classified into three types of digital type, current type and voltage type in terms of a driving type. Among these types, a digital type driving method realizes gray levels by using a TFT as a switch for controlling a driving period without compensating for the unevenness. However, an operating frequency thereof increases by folds as the display size increases, leading to a quite large power consumption and reaching a physical limit of the design within a certain range, and thus the digital type driving method is not appropriate for the application of large size. A current type driving method realizes gray levels by supplying currents of different values to driving transistors directly, which may compensate for the unevenness of TFT and for the IR Drop well. However, in case of writing a low gray level signal, charging a relative large parasitic capacitance on a data line with small current results in a too long writing period, which is especially serious and difficult to be addressed in the display of large size. Similar to the traditional AMLCD driving method, a voltage type driving method provides a voltage signal representing the gray level through a driving IC, the voltage signal will be converted into a current signal of the driving transistor inside the pixel circuit and thus the OLED is driven to achieve a gray level for the lightness. Such a method has advantages of fast driving speed, easy for implementation, and thus is suitable for driving panels of large size and is used widely in the field. However, such a method requires designing additional TFTs and capacitance devices for compensating for the unevenness of TFT, the IR Drop and the unevenness of OLED.

FIG. 1 shows a most traditional pixel circuit structure of voltage-driven type formed by two TFT transistors and one capacitance (2T1C). In this structure, a switching transistor T2 transmits a voltage on a data line to a gate of a driving transistor T1, which in turn converts this data voltage into a corresponding current for supplying to an OLED device. In a normal operation, the driving transistor T1 shall be in a saturated region and provides a constant current during a scanning period for one line. The current can be expressed as:

$$I_{OLED} = \frac{1}{2}\mu_n \cdot C_{OX} \cdot \frac{W}{L} \cdot (V_{data} - V_{oled} - V_{th})^2,$$

wherein $\mu_n$ is a carrier mobility, $C_{OX}$ is a capacitance of gate oxide layer, W/L is a width to length ratio of the transistor, Vdata is the data voltage, Voled is an operating voltage of the OLED shared by all pixel units, and Vth is a threshold voltage of the transistor T1. It can be seen from the above expression, if Vth voltages for respective different pixel units are not the same, the currents thereof differ from each other. If Vth of a pixel shifts as time goes by, it may cause the previous and subsequent currents different, resulting in afterimage. Furthermore, since the unevenness of the OLED devices causes the operating voltages of OLEDs different, it may render the current difference.

There are many pixel structures directed to the unevenness and shift of $V_{th}$ and the unevenness of the OLED. With respect to a design for a back plate of large size and high resolution, a pixel circuit structure of simple configuration and employing fewer elements is needed.

As for the structure in Reference Document [1] as show in FIG. 2, it can compensate for the unevenness and shift of the Vth of driving transistor T4 only, and fails to compensate for the unevenness of OLED.

As for the structure in Reference Document [2] as shown in FIG. 3, it can compensate for the unevenness and shift of Vth of driving transistor T1 and the unevenness of OLED, but needs a complicated configuration formed by six TFTs and one capacitance.

As for the structure in Reference Document [3] as shown in FIG. 4, it can compensate for the unevenness and shift of driving transistor T1 only, and fails to compensate for the unevenness of OLED.

As for the structure in Reference Document [4] as shown in FIG. 5, it can compensate for the effect from the unevenness and shift of Vth and the unevenness of OLED, but needs 5T2C, for which a design of high opening rate is difficult to be realize.

In a summary, in case of designing an AMOLED pixel structure, the driving circuit can not solve the unevenness of TFT, the IR Drop and the unevenness of OLED very well.

The Reference Documents are as follows.

[1] "A New a-Si:H Thin-Film Transistor Pixel Circuit for Active-Matrix Organic Light-Emitting Diodes" IEEE ELECTRON DEVICE LETTERS, VOL. 24, NO. 9, SEPTEMBER 2003.

[2] "A New a-Si:H TFT Pixel Circuit Compensating the Threshold Voltage Shift of a-Si:H TFT and OLED for Active Matrix OLED" IEEE ELECTRON DEVICE LETTERS, VOL. 26, NO. 12, DECEMBER 2005.

[3] "A New Pixel Circuit for Active Matrix Organic Light Emitting Diodes" IEEE ELECTRON DEVICE LETTERS, VOL. 23, NO. 9, SEPTEMBER 2002.

[4] "Amorphous Oxide TFT Backplane for Large Size AMOLED TVs" SID 2010.

SUMMARY

An embodiment of technical solutions disclosed herein provides a voltage-driven pixel circuit, comprising a driving transistor, a retaining transistor, a switching transistor, a compensating transistor, a storage capacitance and an OLED device, a gate of the switching transistor is connected to a gate line, a source thereof is connected to a data line, and a drain thereof is connected to one end of the storage capacitance and a source of the retaining transistor for controlling a writing of a voltage signal in the data line, a gate of the retaining transistor is connected to a first control signal line which is used to control a turn-on of the retaining transistor, a drain of the retaining transistor is connected to a gate of the driving transistor for retaining a gate voltage of the driving transistor, a gate of the compensating transistor is connected to a second control signal line which is used to control a turn-on of the compensating transistor, a source thereof is connected to a drain of the driving transistor, and a drain thereof is connected to the gate of the driving transistor, a source of the driving transistor is connected to the other end of the storage capacitance and an anode of the OLED device for driving the OLED device, the drain of the driving transistor and the source of the compensating transistor are both connected to a first power supply line, a cathode of the OLED device is connected to a second power supply line.

Another embodiment of the technical solutions disclosed herein provides a method for driving the voltage-driven pixel circuit mentioned above, comprising steps of:

S1: turning on the driving transistor, the retaining transistor and the switching transistor and reversely blocking the OLED device so as to pre-charge the source of the driving transistor to a low level;

S2: turning on the compensating transistor and turning off the retaining transistor to pre-charge the storage capacitance to a voltage used to compensate for a threshold voltage of the driving transistor;

S3: turning off the switching transistor and the compensating transistor and turning on the retaining transistor and the OLED device so as to retain the gate voltage of the driving transistor and drive the OLED device to emit light with the voltage stored in the storage capacitance.

Still another embodiment of the technical solutions disclosed herein provides a display panel including the voltage-driven pixel circuit mentioned above.

DETAILED DESCRIPTION OF THE PREFERRED EMBODIMENTS

Figure 1:
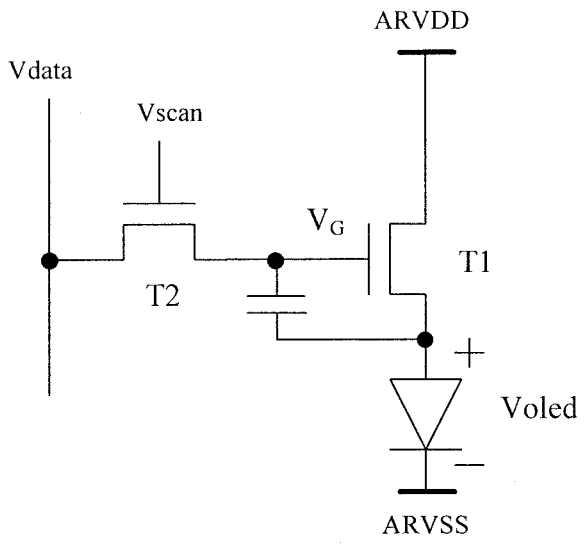
FIG. 1 is a schematic diagram of a structure of a prior voltage-driven pixel circuit.
Figure 2:
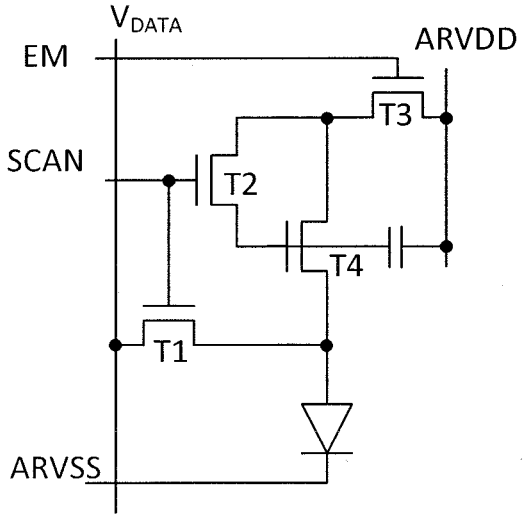
FIG. 2 is a schematic diagram of a structure of another prior voltage-driven pixel circuit.
Figure 2:
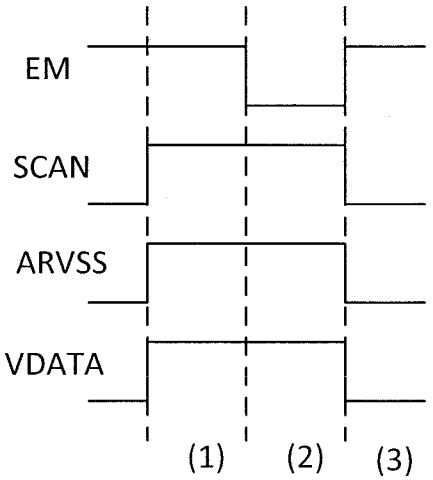
Figure 3:
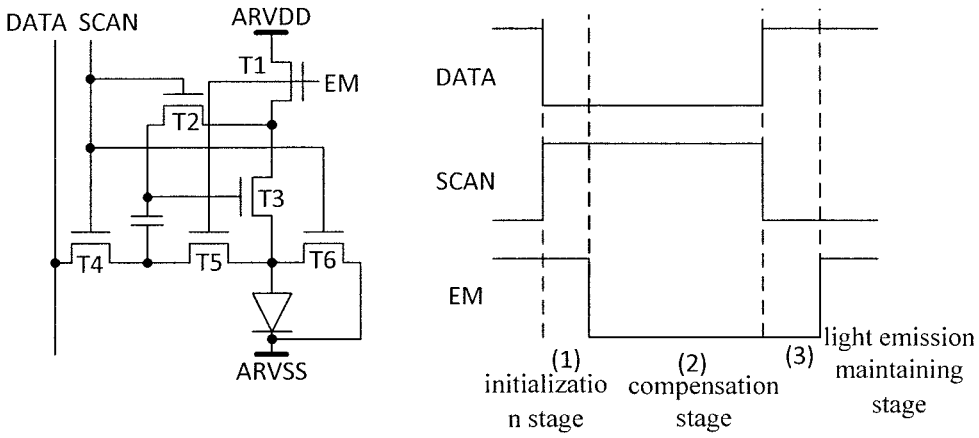
FIG. 3 is a schematic diagram of a structure of another prior voltage-driven pixel circuit.
Figure 4:
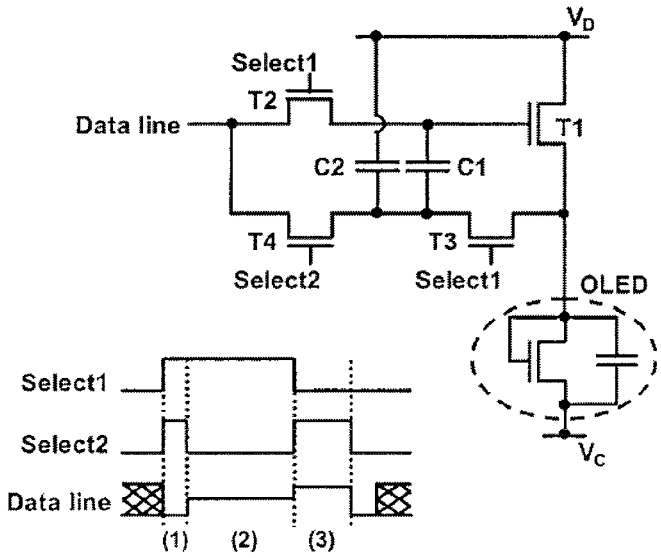
FIG. 4 is a schematic diagram of a structure of another prior voltage-driven pixel circuit.
Figure 5:
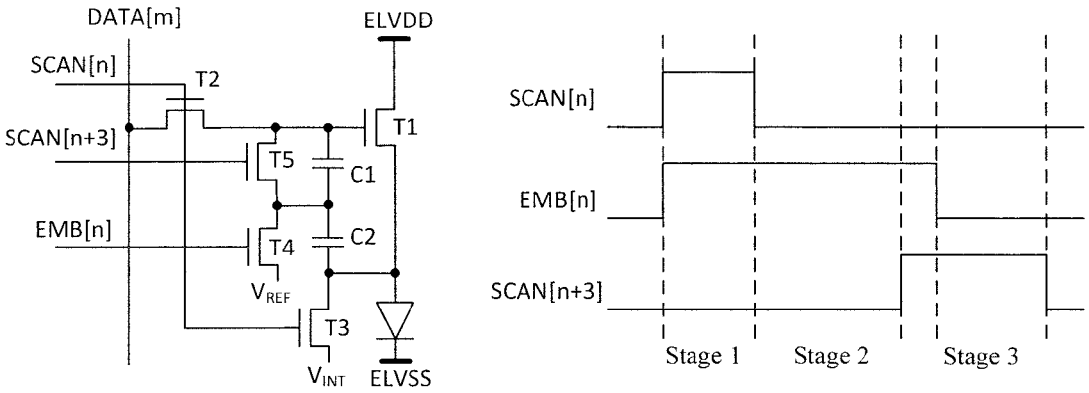
FIG. 5 is a schematic diagram of a structure of another prior voltage-driven pixel circuit.
Figure 6:
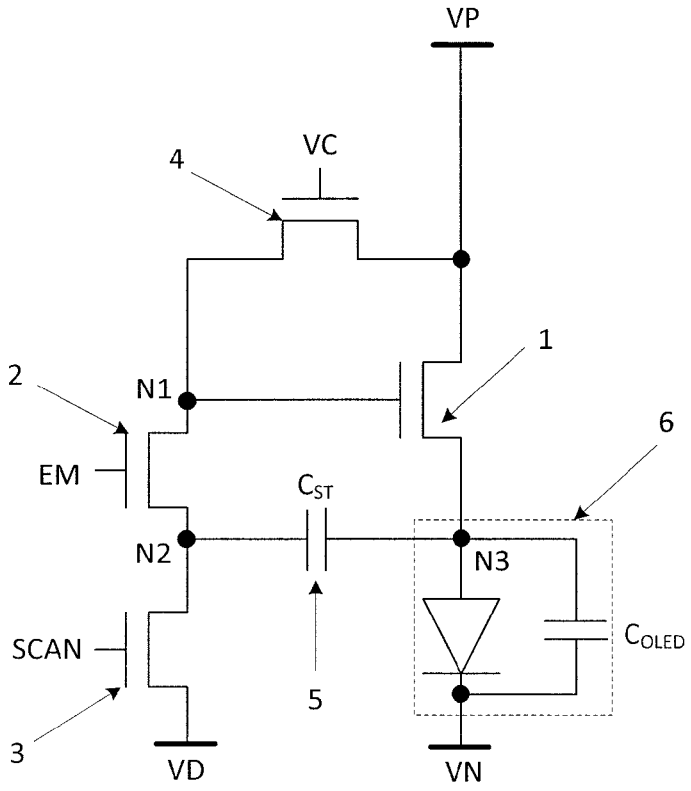
FIG. 6 is a schematic diagram of a structure of a voltage-driven pixel circuit according to an embodiment of present invention.

The implementations of the present invention are further described below in detail with reference to the drawings and embodiments. The embodiments are illustrated for explaining the present invention rather than for limiting the scope thereof As shown in FIG. 6, a voltage-driven pixel circuit includes four TFT transistors (n-type), one capacitance and one OLED device, which are driving transistor 1, retaining transistor 2, switching transistor 3, compensating transistor 4, storage capacitance 5 and OLED device 6, respectively. The OLED device is equivalent to a parallel connection of a light emitting diode and a capacitance $C_{OLED}$ in electrical performance.

A gate of the switching transistor 3 is connected to a gate line SCAN, a source thereof is connected to a data line VD, and a drain thereof is connected to one end of the storage capacitance 5 and a source of the retaining transistor 2 for controlling a writing of a voltage signal in the data line. A gate of the retaining transistor 2 is connected to a first control signal line EM which is used to control the ON/OFF of the retaining transistor, a drain thereof is connected to a gate of the driving transistor 1 for retaining the gate voltage of the driving transistor 1. A gate of the compensating transistor 4 is connected to a second control signal line VC which is used to control the ON/OFF of the compensating transistor 4, a source thereof is connected to a drain of the driving transistor 1, and a drain thereof is connected to the gate of the driving transistor 1. A source of the driving transistor 1 is connected to the other end of the storage capacitance 5 and an anode of the OLED device 6 for driving the OLED device 6. The drain of the driving transistor 1 and the source of the compensating transistor 4 are both connected to a first power supply line VP. A cathode of the OLED device 6 is connected to a second power supply line VN.

Figure 7:
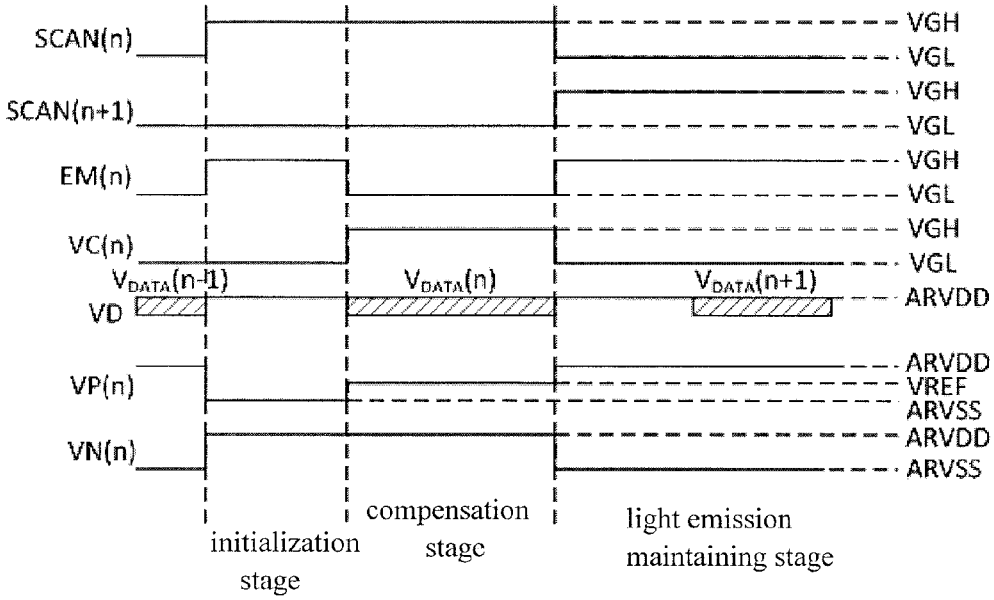
FIG. 7 shows a driving timing sequence of a method for driving the voltage-driven pixel circuit shown in FIG. 6.

FIG. 7 shows a driving timing sequence of a method for driving the voltage-driven pixel circuit described above and FIG. 8 is a schematic diagram of an equivalent circuit structure for the voltage-driven pixel circuit being operated. The driving method comprises three stages: initialization stage, compensation stage, and light emission maintaining stage The main target in the initialization stage is to pre-charge the source N3 of the driving transistor 1 to a low voltage level.

Figure 8:
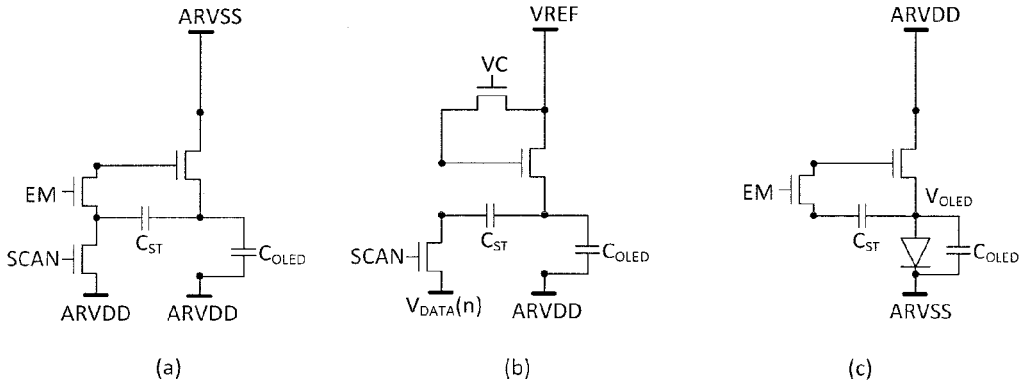
FIG. 8 is a schematic diagram of an equivalent circuit structure for the voltage-driven pixel circuit in FIG. 6 being operated according to the timing sequence shown in FIG. 7.

During the initialization stage, the equivalent circuit is as shown in FIG. 8 (*a*). The data line VD and the second power supply line VN are at a high power supply level (ARVDD), and the first power supply line VP is at a low power supply level (ARVSS). Since the OLED device 6 is equivalent to a parallel connection of a light emitting diode and a capacitance $C_{OLED}$ in electrical performance, the OLED device 6 is reversely blocked. The gate line SCAN and the first control signal line EM are at a high switching level (VGH) and the second control signal line VC is at a low switching level (VGL). At this time, the retaining transistor 2 and the switching transistor 3 are turned on and the compensating transistor 4 is turned off, a circuit through N1 and N2 points transmits the high power supply level ARVDD to N1 point via the retaining transistor 2 and the switching transistor 3, and thus the driving transistor 1 is turned on to cause N3 point to discharge to the ARVSS.

During the compensation stage, the equivalent circuit is as shown in FIG. 8 (*b*). VD is at a data voltage $V_{DATA}$(n) of the current frame (the nth frame), VP is at a reference level of direct current (VREF), VN is at the high power supply level (ARVDD), and the OLED device 6 keeps being reversely blocked. SCAN and VC are at the high switching level (VGH) and EM is at the low switching level (VGL). During this stage, due to a boost effect of the capacitance 5, when VD changes to $V_{DATA}$(n), the voltage of N3 point becomes $V_{DATA}$(n)−ARVDD+ARVSS, which is negative. Because VREF>0 and the driving transistor 1 forms a diode being turned on, the current flows to N3 point from VREF to charge it until the voltage of N3 point rises up to VREF−Vth, which results in the turning off of the driving transistor1. At the end of the compensation stage, the charge stored at the two ends of the capacitance 5 is (VREF−Vth−$V_{DATA}$(n))·$C_{ST}$, wherein $C_{ST}$ is the capacitance value of the storage capacitance.

During the light emission maintaining stage, the equivalent circuit is as shown in FIG. 8(*c*). VP is at the high power supply level (ARVDD), VN is at the low power supply level (ARVSS) and OLED is turned on in a forward direction. SCAN and VC are at the low switching level (VGL) and EM is at the high switching level (VGH), thus the driving transistor 1 and retaining transistor 2 are turned on, and the switching transistor 3 and compensating transistor 4 are turned off. The storage capacitance 5 is connected between the gate and the source of the driving transistor 1 to retain the $V_{GS}$ of the driving transistor 1, and the charges stored in the storage capacitance 5 keeps unchanged. As the current of the OLED device 6 tends to be constant, the voltage of N3 point becomes $V_{OLED}$, and due to the boost effect of the storage capacitance 5, the voltage of N1 and N2 points becomes $V_{OLED}$+$V_{DATA}$(n)−VREF+Vth. The $V_{GS}$ of the driving transistor 1 is kept at $V_{DATA}$(n)−VREF+Vth, in which case the current flowing through the driving transistor 1 is:

$$I_{OLED} = \frac{1}{2}\cdot\mu_n\cdot C_{OX}\cdot\frac{W}{L}\cdot[V_{DATA}(n) - VREF + Vthn - Vth]^2$$
$$= \frac{1}{2}\cdot\mu_n\cdot C_{OX}\cdot\frac{W}{L}\cdot[V_{DATA}(n) - VREF]^2,$$

wherein $\mu_n$ is the carrier mobility, $C_{OX}$ is the capacitance of the gate oxide layer, and W/L is the width to length ratio of the transistor. It can be seen from the above expression, the current is independent of the threshold voltage and the voltage across the OLED, and thus the effect due to the unevenness and shift of the threshold voltage and the unevenness of the electrical performance of the OLED is basically eliminated.

Figure 9:
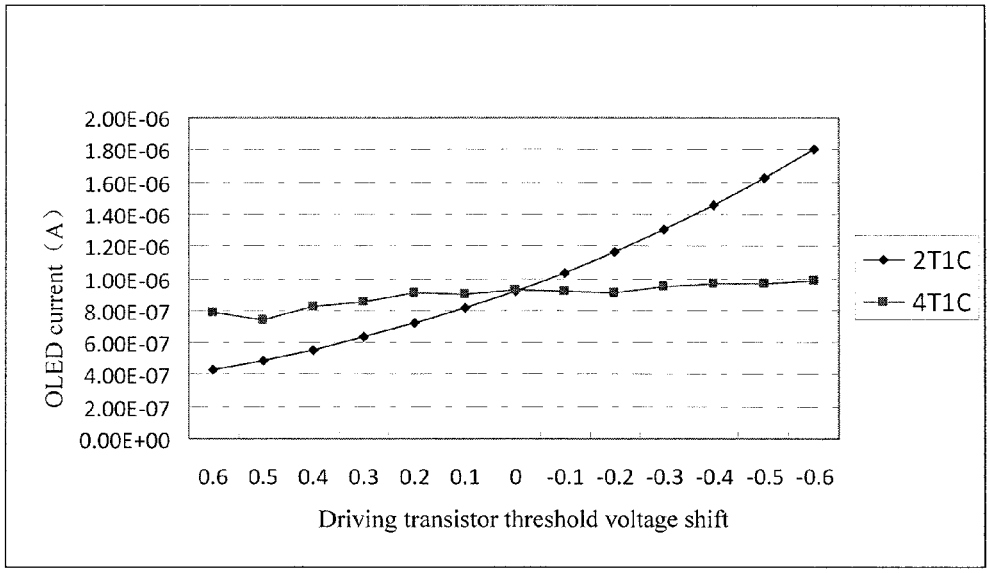
FIG. 9 is a comparison graph showing simulation results of compensating for the unevenness of the TFT threshold voltage between the voltage-driven pixel circuits shown in FIG. 6 and FIG. 1.
Figure 10:
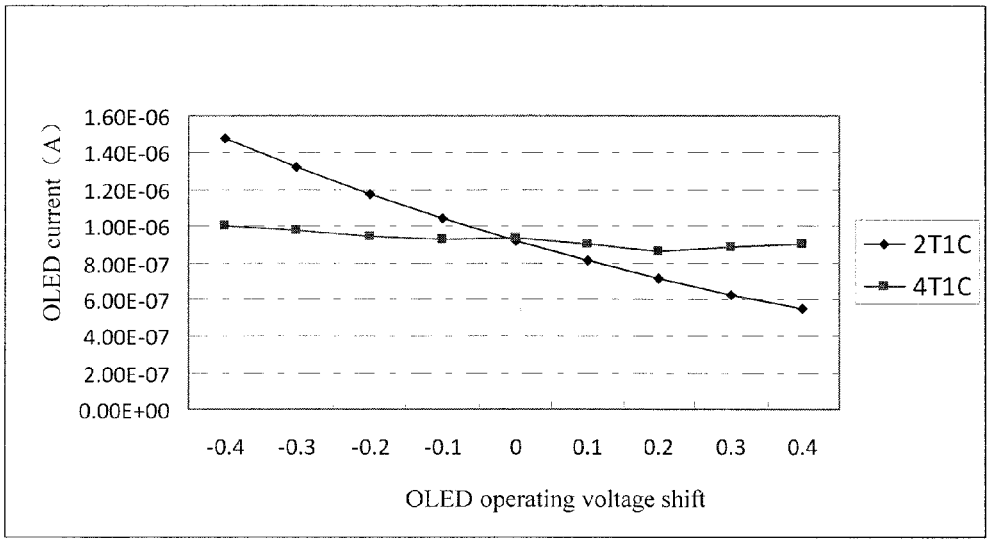
FIG. 10 is a comparison graph showing simulation results of compensating for the unevenness of the voltage of OLED device between the voltage-driven pixel circuits shown in FIG. 6 and FIG. 1.

FIG. 9 shows simulation results of compensating for the unevenness of the threshold voltage, wherein 2T1C is a traditional structure with a compensating function and 4T1C is a circuit structure employed in the embodiments of the disclosed technical solution. In both of the structures, a same width to length ratio W/L=30/10 is employed, and a same TFT model is employed in the simulations. When the threshold voltage shifts ±0.6V, the shift of the OLED current in the traditional 2T1C structure may be up to above 90%, while in the 4T1C structure employed in the embodiment of the disclosed technical solution, the fluctuation of the OLED current is less than 10%. FIG. 10 shows the simulation results of compensating for the unevenness of the OLED voltage. 2T1C is a traditional structure with a compensating function, when the operating voltage of OLED shifts ±0.45V, the maximum shift of the OLED current may be up to 60%, while in the 4T1C structure employed in the embodiments of the disclosed technical solution, the fluctuation of the OLED current is less than 5%.

It can be seen that the circuit employing the 4T1C structure is much more superior in compensating for the unevenness of the threshold voltage and the unevenness of OLED as compared with the 2T1C structure. At the same time, the circuit employing the 4T1C structure requires only four TFTs and one capacitance and thus occupies less area as compared with other similar pixel circuits, thereby a high opening ratio is much easier to be realized.

The technical solution disclosed herein further provides a display panel comprising the voltage-driven pixel circuit as described above. The voltage-driven pixel circuit is formed on an array substrate of the display panel which is provided with a plurality of data lines and gate lines defining a plurality of voltage-driven pixel circuits; the array substrate further comprises a driving chip for providing timing signals to the gate lines, the data lines, the first control signal line and the second control signal line and providing power signal for the first and second power supply lines. Since this display panel employs the voltage-driven pixel circuit described above, the display quality is good and the afterimage phenomenon is avoided.

The above embodiments are illustrated for explaining the present invention rather than restricting it. Various modifications and alterations can be made by those skilled in the art without departing from the spirit and scope of present invention. All equivalent technical solutions shall fall into the scope of present invention which should be defined by the claims appended.

What is claimed is:

1. A voltage-driven pixel circuit, comprising a driving transistor, a retaining transistor, a switching transistor, a compensating transistor, a storage capacitance and an OLED device, wherein a gate of the switching transistor is connected to a gate line, a source thereof is connected to a data line, and a drain thereof is connected to one end of the storage capacitance and a source of the retaining transistor, the switching transistor is configured to control a writing of a voltage signal in the data line, a gate of the retaining transistor is connected to a first control signal line which is used to control a turn-on of the retaining transistor, a drain of the retaining transistor is connected to a gate of the driving transistor, the retaining transistor is configured to retain a gate voltage of the driving transistor, a gate of the compensating transistor is connected to a second control signal line which is used to control a turn-on of the compensating transistor, a source thereof is connected to a drain of the driving transistor, and a drain thereof is connected to the gate of the driving transistor, a source of the driving transistor is connected to the other end of the storage capacitance and an anode of the OLED device, the driving transistor is configured to drive the OLED device, the drain of the driving transistor and the source of the compensating transistor are both connected to a first power supply line, a cathode of the OLED device is connected to a second power supply line.

2. A method for driving the voltage-driven pixel circuit according to claim 1, comprising steps of:

S1: turning on the driving transistor, the retaining transistor and the switching transistor and reversely blocking the OLED device so as to pre-charge the source of the driving transistor to a low level;

S2: turning on the compensating transistor and turning off the retaining transistor to pre-charge the storage capacitance to a voltage used to compensate for a threshold voltage of the driving transistor; II S3: turning off the switching transistor and the compensating transistor and turning on the retaining transistor and the OLED device so as to retain the gate voltage of the driving transistor and drive the OLED device to emit light with the voltage stored in the storage capacitance.

3. The method according to claim 2, wherein the step S1 comprises:

inputting a high power supply level to the data line and the second power supply line and inputting a high switching level to the first control signal line and the gate line to turn on the retaining transistor, the switching transistor and the driving transistor, inputting a low switching level from the second control signal line to turn off the compensating transistor, and connecting the first power supply line to a low power supply level to block the OLED device, so as to discharge the source of the driving transistor to the low power supply level.

4. The method according to claim 2, wherein the step S2 comprises:

changing the voltage of the data line to a data voltage of a current frame, inputting a direct reference level to the first power supply line, inputting a low switching level to the first control signal line to turn off the retaining transistor, and inputting a high switching level to the second control signal line to turn on the compensating transistor, so as to pre-charge the storage capacitance to the voltage used to compensate for the threshold voltage of the driving transistor.

5. The method according to claim 2, wherein the step S3 comprises:

inputting a low switching level from the gate line and the second control signal line to turn off the switching transistor and the compensating transistor, inputting a high switching level from the first control signal line to turn on the retaining transistor, and connecting the first power supply line to a high power supply level and connecting the second power supply line to a low power supply level to turn on the OLED device, so as to drive the OLED device to emit light with the voltage stored in the storage capacitance.

6. A display panel including the voltage-driven pixel circuit according to claim 1.

7. The display panel according to claim 6, wherein the voltage-driven pixel circuit 1S formed on an array substrate of the display panel which is provided with a plurality of data lines and gate lines defining a plurality of voltage-driven pixel circuits; the array substrate further comprises a driving chip for providing timing signals to the gate lines, the data lines, the first control signal line and the second control signal line and providing power signals for the first and second power supply lines.

* * * * *